US010570535B2

(12) United States Patent
Liukkonen et al.

(10) Patent No.: US 10,570,535 B2
(45) **Date of Patent: *Feb. 25, 2020**

(54) CHEMICAL METHOD AND SYSTEM FOR THE MANUFACTURE OF FIBROUS YARN

(71) Applicant: Spinnova Oy, Vaajakoski (FI)

(72) Inventors: Johanna Liukkonen, Jyväskylä (FI); Sanna Haavisto, Jyväskylä (FI); Pasi Selenius, Lievestuore (FI); Juha Salmela, Laukaa (FI); Janne Poranen, Muurame (FI)

(73) Assignee: Spinnova Oy, Vaajakoski (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/569,089

(22) PCT Filed: Apr. 25, 2016

(86) PCT No.: PCT/FI2016/050269

§ 371 (c)(1),
(2) Date: Oct. 25, 2017

(87) PCT Pub. No.: WO2016/174307

PCT Pub. Date: Nov. 3, 2016

(65) Prior Publication Data

US 2018/0112335 A1 Apr. 26, 2018

Related U.S. Application Data

(60) Provisional application No. 62/153,656, filed on Apr. 28, 2015.

(51) Int. Cl.

| | |
|---|---|
| ***D21H 17/53*** | (2006.01) |
| ***D02G 3/04*** | (2006.01) |
| ***D02G 3/08*** | (2006.01) |
| ***D21H 17/55*** | (2006.01) |
| ***D21H 17/63*** | (2006.01) |
| ***D21H 17/68*** | (2006.01) |
| ***D21H 19/12*** | (2006.01) |
| ***D21H 21/14*** | (2006.01) |

(52) U.S. Cl.

CPC ..... *D02G 3/04* (2013.01); *D02G 3/08* (2013.01); *D21H 17/53* (2013.01); *D21H 17/55* (2013.01); *D21H 17/63* (2013.01); *D21H 17/68* (2013.01); *D21H 19/12* (2013.01); *D21H 21/14* (2013.01)

(58) Field of Classification Search

USPC ..... 162/138

See application file for complete search history.

(56) References Cited

U.S. PATENT DOCUMENTS

| | | | |
|---|---|---|---|
| 3,943,220 | A | 3/1976 | Barnett et al. |
| 5,221,502 | A | 6/1993 | Washington |
| 8,945,453 | B2 | 2/2015 | Kitagawa et al. |
| 2005/0022956 | A1 | 2/2005 | Rodriquez |
| 2014/0121622 | A1 | 5/2014 | Jackson et al. |
| 2018/0119315 | A1* | 5/2018 | Liukkonen ..... D02G 3/04 |

FOREIGN PATENT DOCUMENTS

| | | | |
|---|---|---|---|
| CN | 101078184 | A | 11/2007 |
| CN | 103233386 | A | 8/2013 |
| GB | 730228 | A | 5/1955 |
| JP | 2009167578 | A | 7/2009 |
| JP | 2009173909 | A | 8/2009 |
| JP | 2010209510 | A | 9/2010 |
| WO | 9409190 | A1 | 4/1994 |
| WO | 2009167578 | A | 4/1994 |
| WO | 2009084566 | A1 | 7/2009 |
| WO | 2013034814 | A1 | 3/2013 |
| WO | 2013070884 | A2 | 5/2013 |
| WO | 2014065747 | A1 | 5/2014 |
| WO | 2016174306 | A1 | 11/2016 |

OTHER PUBLICATIONS

Finnish Patent and Registration Office, Search report of PCT/FI2016/050269, dated Aug. 26, 2106.

Extended European search report of EP16786019.6 issued by European Patent Office dated Jan. 4, 2019, 8 pages.

* cited by examiner

*Primary Examiner* — Mark Halpern

(74) *Attorney, Agent, or Firm* — Berggren LLP

(57) ABSTRACT

The present invention discloses a method for the manufacture of fibrous yarn. The said method includes the steps of providing an aqueous suspension having fibers and at least one rheology modifier, followed by directing said suspension through at least one nozzle, to form at least one yarn. The method further includes subjecting the said at least one yarn to dewatering. The method is characterized in that a hydrogel is provided onto surface of the yarn that exits the at least one nozzle. Further disclosed is a system for manufacture of fibrous yarn and the fibrous yarn so produced during the manufacturing.

5 Claims, 6 Drawing Sheets

CHEMICAL METHOD AND SYSTEM FOR THE MANUFACTURE OF FIBROUS YARN

PRIORITY

This application is a U.S. national application of the international application number PCT/FI2016/050269 filed on Apr. 28, 2016 and claiming priority of US provisional application 62/153656 filed on Apr. 28, 2015, the contents of both of which are incorporated herein by reference.

FIELD OF THE DISCLOSURE

The invention relates to a method and a system for the manufacture of fibrous yarn, especially from natural fibers. Further, the invention relates to fibrous yarn obtainable by said method, as well as uses of said fibrous yarn.

BACKGROUND OF THE DISCLOSURE

Many different types of yarns made of natural fibers are known in the art. One well known example is paper yarn, which is traditionally manufactured from paper sheets. Typically, paper yarns are made from paper by first cutting the paper to narrow strips. These strips are then twisted to produce one paper yarn filament. These filaments are reeled to big reels and post processed to give different end properties. After this yarns are spun to smaller reels and finally dried in special drying unit.

The paper yarn has limited applications because of deficiencies in its properties, such as limited strength, unsuitable thickness, layered or folded structure, and further, the manufacturing method is inefficient.

In manufacturing paper yarn, the wet extrusion nozzle plays a key role in fiber orientation and in crosslinking of the fibers. However, to achieve the best possible yarn strength the fibers must be well twisted. Moreover, to improve the internal bonding of the fibers the fibers must be bonded together. The previous known solutions provide a nozzle having a diameter smaller than average fiber length which provides an upper limit to achievable yarn diameter. One such system and method has been disclosed in WO publication number 2013/0347814.

In this WO '814 publication a system and a method for manufacturing a fibrous yarn is disclosed. The method and system involves providing an aqueous suspension comprising fibers and a rheological modifier. The suspension provided is passed through a nozzle and then dewatered using a dewatering system.

The dewatering system disclosed in the process, however, created undue stresses on the paper yarn. These undue stresses more often result in breakage of the yarn during twisting and dewatering processes.

Another document U.S. Pat. No. 8,945,453 discloses method for producing polytetrafluoroethylene fiber and polytetrafluoroethylene fiber. The '453 patent document discloses a nozzle structure adapted to produce a polytetrafluoroethylene fiber from an aqueous suspension. However, the '453 patent document does not provide any solution for enhancing the strength of natural fibrous yarn so that the breakage of the yarn during the dewatering process can be avoided.

Accordingly, there is a need for controlling the yarn strength so that the breakage of the yarn could be avoided during the twisting and the dewatering processes. Further, there is a need for a device and a way to successfully deliver fiber yarn to the dewatering or the drying section of the process.

Furthermore, there is a need to use the knowledge on the structure and dynamics of the materials and their reactions to allow continuous production of fibrous yarn, in such processes. Moreover, a precise control of operational conditions (physical conditions: temperature, pressure, velocity, dwelling time; chemical conditions: pH, concentrations) has to be found.

SUMMARY

Aspects of the invention are thus directed to a method and system for manufacturing a fibrous yarn. Initially an aqueous suspension having fibers and at least one rheology modifier is prepared. The said aqueous suspension is directed through at least one nozzle and at the exit of the nozzle an aqueous fibrous yarn product comes out. At the exit of the nozzle the said aqueous fibrous yarn product is merged with a hydrogel. Specifically, the said hydrogel is coated on the surface of the said aqueous fibrous yarn product. Finally the said aqueous fibrous yarn product is subjected to a dewatering process.

It is an object of the present invention to provide a method and system for manufacturing a fibrous yarn. The fibrous yarn so produced is pulled and twisted simultaneously while the aqueous suspension flows through the exit of the nozzle to form an aqueous fibrous yarn product.

Aspects of the present invention may provide a method and system for manufacturing a fibrous yarn, wherein, the aqueous suspension at the exit of the nozzle is merged with an annular flow of a metal alginate hydrogel. The said metal alginate hydrogel is adapted to crosslink the aqueous fibrous yarn product. The said metal alginate hydrogel is prepared by adding bivalent metal cations to a solution of alginate.

Aspects of the present invention may provide a method and system for manufacturing a fibrous yarn, wherein, a plurality of fibrous yarns is combined through a plurality of annular flow channels. The plurality of annular flow channels, as referenced herein, include an innermost annular flow channel, an outermost annular flow channel, and an annular flow channel sandwich between the innermost annular flow channel and the outermost annular flow channel. The innermost annular flow channel is adapted to accommodate the fiber suspension and the rheology modifier. The outermost annular flow channel is adapted to accommodate the metal alginate hydrogel. The sandwiched annular flow channel is adapted to accommodate the yarn property improving additives.

Aspects of the present invention may provide a method and system for manufacturing a fibrous yarn, wherein, the fibrous yarn is pressed mechanically from at least two opposite sides by a plurality of plates floating on a deformable base.

A method for the manufacture of fibrous yarn, said method includes:

- preparing an aqueous suspension comprising fibers and at least one rheology modifier;
- directing said aqueous suspension through at least one nozzle, to form at least one yarn; and
- then subjecting the said at least one yarn to dewatering, characterized in that, providing a hydrogel onto surface of the yarn that exits the at least one nozzle.

A system for manufacture of fibrous yarn, wherein the system includes:

an aqueous suspension having fibers and at least one rheology modifier is provided, and said aqueous suspension is arranged through at least one nozzle, to form at least one yarn, and said at least one yarn is arranged to be subjected to dewatering, characterized in that, a hydrogel is arranged to be provided onto surface of the at least one yarn that exits the at least one nozzle Fibrous yarn having a dewatered aqueous suspension of fibers and at least one rheology modifier, wherein, the aqueous suspension of fibers has exited a nozzle and has hydrogel provided onto the exiting yarn.

In one embodiment, the aqueous suspension is allowed to swirl around the main flow axis of the at least one nozzle by feeding the aqueous suspension to the at least one nozzle asymmetrically from the side of the said at least one nozzle.

In another embodiment, the aqueous suspension is allowed to swirl around the main flow axis of the at least one nozzle by creating, rotating and accelerating a flow of the aqueous suspension, where all the fibers are well aligned with the said flow by rotating around the main flow axis.

In yet another embodiment, the aqueous suspension is allowed to swirl around the main flow axis of the at least one nozzle by creating a swirling flow by using a plurality of grooved flow channels.

In yet another embodiment, the aqueous suspension is allowed to swirl around the main flow axis of the at least one nozzle by creating a swirling flow by using a plurality of bend flow channels. The bend flow channels may comprise ninety degree bend flow channels.

In addition and with reference to the aforementioned, embodiments of the invention comprise the aqueous suspension having fibers and at least one rheology modifier is allowed to swirl around the main flow axis of the nozzle. Such swirling of the aqueous suspension around the main flow axis of the nozzle is completed by feeding the aqueous suspension asymmetrically from the side of the nozzle. Further, yarn property improving additives are also added to the aqueous suspension. Furthermore, a metal alginate hydrogel is merged with the flow of the aqueous suspension at the exit of the nozzle. Moreover, the aqueous suspension at the exit of the nozzle is pulled and twisted and then subjected to pressing and dewatering process.

A tailored hydrogel formation provides many advantages. The hydrogel enables the successful delivery of the fiber yarn into the drying section and protects the formed yarn from breaking during the twisting and dewatering. In addition to the fibers, also other materials that improve the properties of the yarn, can be bound in the hydrogel matrix.

Particularly, the ease of manufacture of the fibrous yarn, possibility to design the properties of the yarn according to the intended use, small water footprint, biodegradability are some examples of the desired benefits achieved by the present invention.

This together with the other aspects of the present invention along with the various features of novelty that characterized the present disclosure is pointed out with particularity in claims annexed hereto and forms a part of the present invention. For better understanding of the present disclosure, its operating advantages, and the specified objective attained by its uses, reference should be made to the accompanying descriptive matter in which there are illustrated exemplary embodiments of the present invention.

DESCRIPTION OF THE DRAWINGS

The examples and features of the present invention will become better understood with reference to the following detailed description taken in conjunction with the accompanying drawings, in which.

Like reference numerals refer to like parts throughout the description of several views of the drawing.

DESCRIPTION OF THE INVENTION

Figure 1:
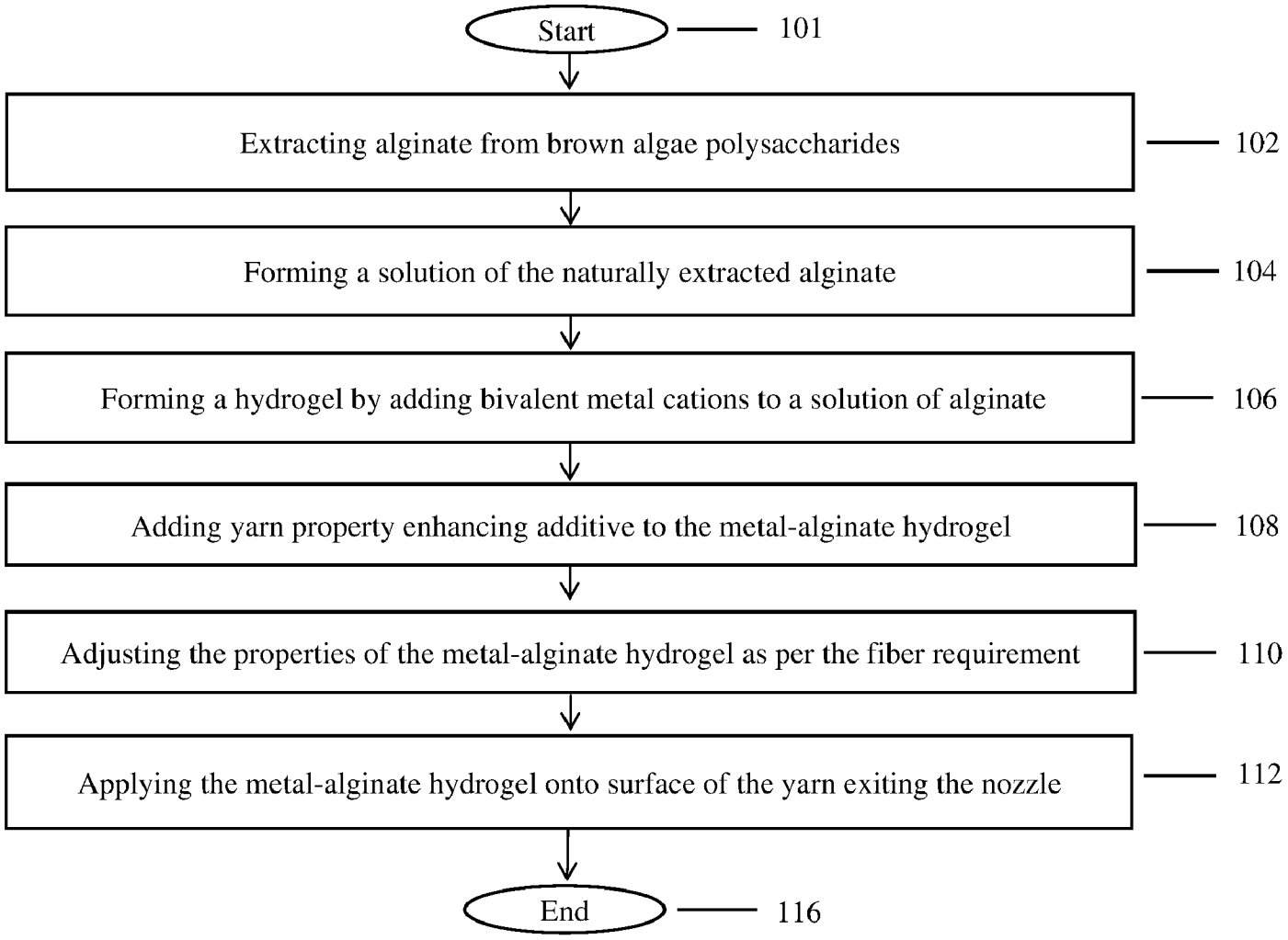
FIG. 1 illustrates a flow diagram for preparing a cross-linking metal alginate hydrogel, according to various embodiments of the present invention.

The exemplary embodiments described herein detail for illustrative purposes are subjected to many variations. It should be emphasized, however, that the present invention is not limited to method and system for producing fibrous yarn. It is understood that various omissions and substitutions of equivalents are contemplated as circumstances may suggest or render expedient, but these are intended to cover the application or implementation without departing from the spirit or scope of the present invention.

Unless otherwise specified, the terms, which are used in the specification and claims, have the meanings commonly used in the field of paper and pulp manufacture, as well as in the field of yarn manufacture. Specifically, the following terms have the meanings indicated below.

The terms "a" and "an" herein do not denote a limitation of quantity, but rather denote the presence of at least one of the referenced item.

The terms "having", "comprising", "including", and variations thereof signify the presence of a component.

The term "fiber" refers here to raw fibrous material either produced naturally or produced artificially.

The term "yarn" refers here to thread, yarn, chord, filament, wire, string, rope and strand.

The term "rheology modifier" is understood to mean here a compound or agent capable of modifying the viscosity, yield stress, thixotropy of the suspension.

It should be noted that the term "maximum length weighed fiber length of the fibers" as referenced herein below means length weighted fiber length where 90 percent of fibers are shorter or equal to this length, wherein fiber length may be measured with any suitable method used in the art.

The term "crosslinking agent" is understood to mean here a compound or agent, such as a polymer, capable of cross-linking on fiber with itself in the suspension. This typically takes place in the water solution phase and leads to a gel.

The term "hydrogel" is understood to mean here a gel like composition having plurality of solid particles suspended in a liquid phase.

The term "aqueous suspension" in the present invention is understood to mean any suspension including water and fibers originating from any and at least one plant based raw material source, or synthetic fiber. The plant based raw material source including cellulose pulp, refined pulp, waste paper pulp, peat, fruit pulp, or pulp from annual plants. The fibers may be isolated from any cellulose containing material using chemical, mechanical, thermo-mechanical, or chemi-thermo-mechanical pulping processes. The synthetic fibers may comprise polyester, nylon or the like.

The term "microfibrillated cellulose", "nanofibrillar cellulose" and/or "nanofibrillated cellulose" as used hereinafter refer to a collection of isolated cellulose microfibrils or microfibril bundles derived from cellulose raw material. Microfibrils have typically high aspect ratio: the length might exceed one micrometer while the number-average diameter is typically below 200 nm. The diameter of microfibril bundles may also be larger but generally less than 1 μη. The smallest microfibrils are similar to so called elementary fibrils, which are typically 2-12 nm in diameter. The dimensions of the fibrils or fibril bundles are dependent on raw material and disintegration method.

The nanofibrillar cellulose may also contain some hemicelluloses; the amount is dependent on the plant source. Mechanical disintegration of microfibrillar cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer or fluidizer-type homogenizer. In this case the nanofibrillar cellulose is obtained through disintegration of plant cellulose material and may be called "nanofibrillated cellulose".

"Nanofibrillar cellulose" may also be directly isolated from certain fermentation processes. The cellulose-producing microorganism of the present invention may be of the genus *Acetobacter, Agrobacterium, Rhizobium, Pseudomonas* or *Alcaligenes,* preferably of the genus *Acetobacter* and more preferably of the species *Acetobacter xylinum* or *Acetobacter pasteurianus.*

"Nanofibrillar cellulose" may also be any chemically or physically modified derivate of cellulose nanofibrils or nanofibril bundles. The chemical modification could be based for example on carboxymethylation, oxidation, esterification, or etherification reaction of cellulose molecules. Modification may also be realized by physical adsorption of anionic, cationic, or non-ionic substances or any combination of these on cellulose surface. The described modification may be carried out before, after, or during the production of microfibrillar cellulose.

The nanofibrillated cellulose may be made of cellulose which is chemically premodified to make it more labile. The starting material of this kind of nanofibrillated cellulose is labile cellulose pulp or cellulose raw material, which results from certain modifications of cellulose raw material or cellulose pulp. For example N-oxyl mediated oxidation (e.g. 2,2,6,6-tetramethyl-l-piperidine N-oxide) leads to very labile cellulose material, which is easy to disintegrate to microfibrillar cellulose. For example patent applications WO 09/084566 and JP 20070340371 disclose such modifications. The nanofibrillated cellulose manufactures through this kind of premodification or "labilization" is called "NFC-L" for short, in contrast to nanofibrillated cellulose which is made of not labilized or "normal" cellulose, NFC-N.

The nanofibrillated cellulose is preferably made of plant material where the nanofibrils may be obtained from secondary cell walls. One abundant source is wood fibers. The nanofibrillated cellulose is manufactured by homogenizing wood-derived fibrous raw material, which may be chemical pulp. When NFC-L is manufactured from wood fibers, the cellulose is labilized by oxidation before the disintegration to nanofibrils. The disintegration in some of the above-mentioned equipment produces nanofibrils which have the diameter of only some nanometers, which is 50 nm at the most and gives a clear dispersion in water. The nanofibrils may be reduced to size where the diameter of most of the fibrils is in the range of only 2-20 nm only. The fibrils originating in secondary cell walls are essentially crystalline with degree of crystallinity of at least 55%.

Embodiments of the present invention provide an aqueous solution suspension by mixing raw fibrous material with additives and then adding foam in such mixture. Thereafter, the said aqueous solution suspension is administered from the side of a nozzle and the aqueous sol suspension start to swirl around a main flow axis of the nozzle. Due to the gravitational pull, an aqueous fibrous yarn product comes out from an exit of the nozzle. Also fluid pressure may be used to eject the fibrous gel yarn from the nozzle in some embodiments. Further a wire may also be used to pull the yarn from the nozzle, wherein the speed differential between the gel yarn and the wire is sometimes used to induce the exit of the gel yarn from the nozzle. At the exit of the nozzle the said aqueous fibrous yarn suspension is merged with a crosslinking agent and as a result of cross-linking reaction a hydrogel is created, such as a metal alginate hydrogel. Specifically, the said metal alginate hydrogel is coated on the surface of the said aqueous fibrous yarn product.

Thereafter, the aqueous fibrous yarn product coated with the metal alginate hydrogel is subjected to twisting, drying and dewatering process. The drying may include methods based on vacuum, mechanical pressing and/or thermal drying. The dewatering may be carried out by methods utilizing vacuum, mechanical pressing, convection, conduction or radiation of heat, by any suitable heating means such as heated airflow, IR, or contact with heated surface.

In an embodiment, the fibrous yarn is dewatered by using the mechanical pressing method. The mechanical pressing method as proposed by the present invention includes a plurality of plates floating on a deformable base. The plurality of plates floating on a deformable base is adapted to dewater the fibrous yarn without any wear and tear to the final yarn product. When the fibrous yarn passes through these pluralities of floating plates only pressure required for dewatering the fibrous yarn is applied. Accordingly, the use of minimum pressure during dewatering process is helpful to produce a yarn product having suitable thickness as well as a uniform structure. After the dewatering process, the yarn is dried and the dry yarn product is obtained.

FIGS. 1-6 describe the novel and inventive aspects related to the method, system and the yarn of the present invention. The novel and inventive aspects as illustrated in the drawings may be read in conjugation to the claims of the present invention.

FIG. 1 provides one suitable embodiment for preparing the metal alginate hydrogel of the present invention. Firstly, the alginate is derived naturally from the brown algae polysaccharides as per step 102. Then a solution of such naturally extracted alginate is formed as per step 104. Thereafter, the metal alginate hydrogel is formed by adding bivalent metal cations to such alginate solution as per step 106. Further, yarn property enhancing additive is added to such metal alginate hydrogel as per step 108. Moreover, the properties of said metal alginate hydrogel are adjusted as per the requirement of the yarn product as per step 110. Finally, at the exit of the nozzle the fibrous yarn is coated with such metal alginate hydrogel as per step 112.

The tailored metal alginate hydrogel coating over the surface of the said fibrous yarn will enable the successful delivery of the fibrous yarn in to the drying section and protects the fibrous yarn from breakage during the twisting and dewatering process. In addition to the fibers, also other materials that improve the properties of the fibrous yarn, can be found in the metal alginate hydrogel matrix. Finally, the said aqueous fibrous yarn product is subjected to twisting, drying and dewatering process.

Specifically, the coating of the metal alginate hydrogel over the surface of the aqueous fibrous yarn product provides a means of crosslinking the fibers. Accordingly, this crosslinking of fibers provides a fibrous yarn product with enhanced strength and stretch and thus the breakage of the yarn could be avoided during the twisting and the dewatering processes.

Preferably, the metal alginate hydrogel as provided herein includes alginate as naturally derived from brown algae polysaccharides and then forming an aqueous solution of such alginate. The structure of the alginate is an unbranched polysaccharide consisting of mannuronic acid (M) and guluronic acid (G). When cations such as bivalent metal cations are added to a solution of alginate, a metal alginate hydrogel having a cross-linked structure is formed. The properties of the cross-linked structure of the said metal alginate hydrogel depend on following factors such as:

- biopolymer selection i.e. alginate, guar gum, pectin etc.;
- solubility of biopolymer to water;
- reactivity (cross-linking density and speed) of the biopolymer with the metal ions;
- control of the metal alginate hydrogel swelling/shrinking (pH) to control the release of water from the metal alginate hydrogel matrix.

In the presence of metal cations, particularly divalent or multivalent cations (cross linking reagent), suitably such as Ca2+, Al2+. Na2+. Mg2+, Sr2+ or Ba2+, (cross linking agent), alginate, pectin and carrageenan (carrageenan cross-links also with K+) readily form a stable and strong gel. In the cross-linking of these polysaccharides calcium chloride is preferably used. The concentration of salt solution may vary from 1% w/w to 10% w/w.

Typically the poly-L-guluronic acid (G-block) content of alginate, poly-D-galacturonic acid content of pectin or carrageenan and the amount of divalent or multivalent cations (calcium ions) are regarded as being involved in determining gel strength.

Figure 2:
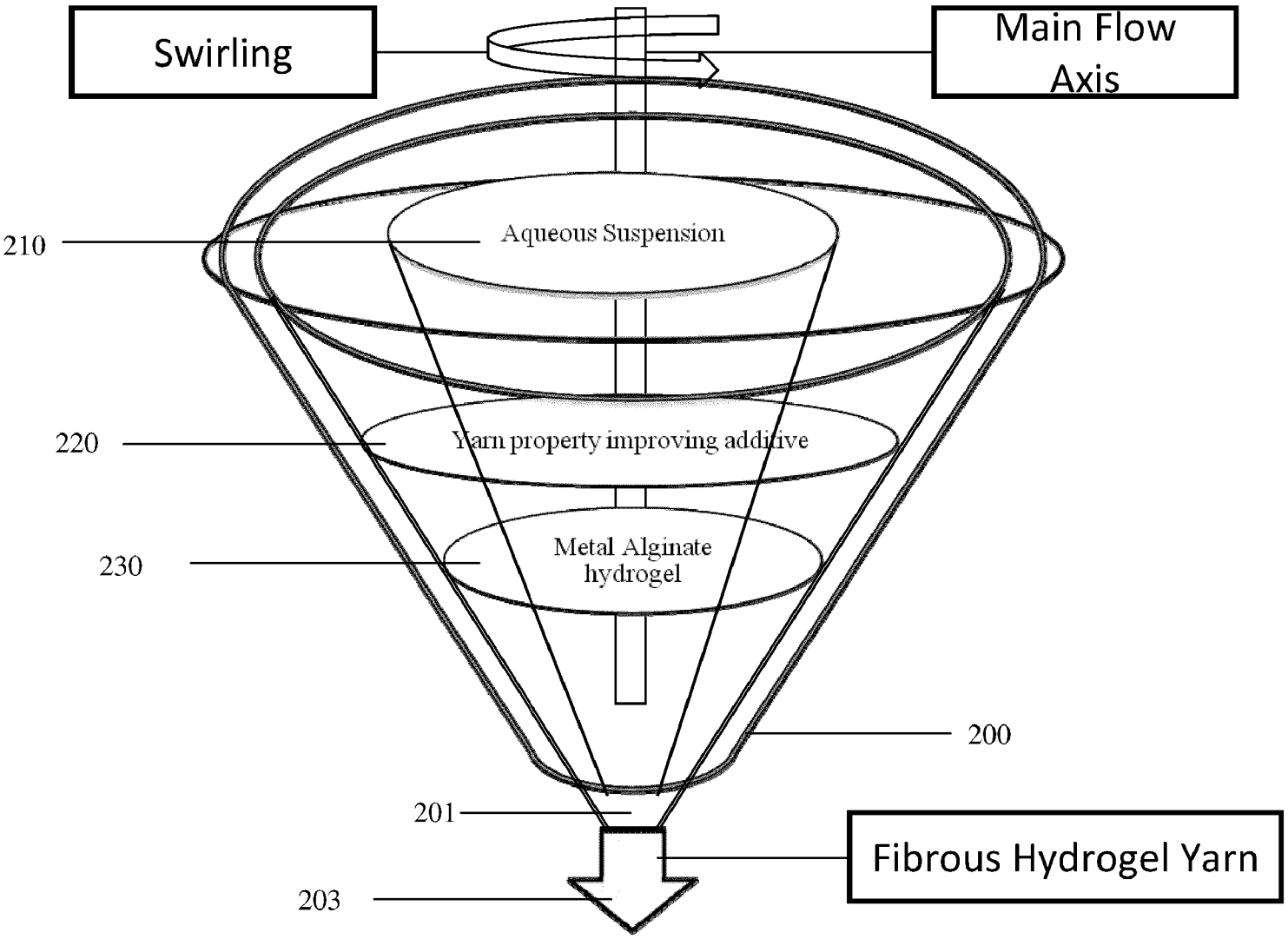
FIG. 2 illustrates a block diagram of the nozzle and the use of cross-linking metal alginate hydrogel along with the fibrous suspension, according to various embodiments of the present invention.

FIG. 2 provides the block diagram for the nozzle adapted to produce the yarn in conjugation with the cross-linking of suspension by the metal alginate hydrogel.

In various embodiments of the present invention, it was surprisingly found that fibrous yarn may be manufactured in a very simple and efficient way directly from a fibrous suspension, whereby it is not necessary to manufacture first paper or other fibrous product, which is sliced into strips and wound to a yarn.

It will be understood by the person skilled in the art that in the process for manufacturing of fibrous yarn, a suspension is usually directed through a nozzle and thereafter the fibrous yarn is dewatered. One way of manufacturing such fibrous yarn has been disclosed in WO publication number WO 2013/034814 A1. Suitably the amount of nozzles required in the system is selected depending upon the manufacturing equipment used and on the product which is manufactured.

Usually, any nozzle or extruder suitable for liquids and viscous fluids may be used in such system. When the suspension contains alginates, pectin or carrageenan, suitably a nozzle is used including an inner die or orifice for the suspension and outer die or orifice for an aqueous solution comprising at least one cation. Cation may comprise a salt, such as calcium chloride or magnesium sulphite. Alternatively, the solution comprising the cation (salt) may be provided as a spray or mist when using nozzles with one orifice. The cation, when brought in contact with for example with alginate or alginic acid, provides effect of very rapid increase on the viscosity of the aqueous suspension whereby the strength of the yarn is increased, making the embodiment of the method utilizing the gravitational force very attractive.

Moreover, the inner diameter of the outlet of the nozzle is kept smaller than or equal to the maximum length weighed fiber length of the fibers. This helps to orientate the fibers essentially in the direction of the yarn and provides strength and flexibility to the product.

The nozzle of the present invention is specially designed. This specially designed nozzle has been disclosed in cross-referenced patent application No. 62/153,635 titled "MECHANICAL METHOD AND SYSTEM FOR THE MANUFACTURE OF FIBROUS YARN" from the same inventors. This application is incorporated into the present application, and any features of the present application may be replaced with the features of the aforementioned application.

Now referring to FIG. 2, a nozzle 200 has been provided, wherein the aqueous suspension 210 is directed from the side of the nozzle and the aqueous suspension is allowed to swirl around the main flow axis of the nozzle. Further, yarn property improving additives 220 are added to the aqueous suspension. The aqueous suspension includes raw fibrous material mixed with foam material. At the exit 201 of the nozzle 200, the aqueous fibrous yarn is merged with the annular flow of the metal alginate hydrogel 230.

Further, the present invention provides a mechanism by which the fibrous yarn is simultaneously pulled and twisted while the aqueous suspension (210) flows through the exit of the nozzle (200). Such pulling and twisting of the fibrous yarn increases the strength and stretch of the final yarn product.

After exiting the nozzle (200) the aqueous yarn suspension is subjected to dewatering and drying.

In various embodiments, the nozzle (200) is adapted to swirl the flow of the aqueous suspension (210) around a main flow axis of the said nozzle (200).

In another embodiment, the aqueous suspension (210) is allowed to swirl around the main flow axis of the at least one nozzle (200) by feeding the aqueous suspension asymmetrically from the side of the said nozzle (200).

In another embodiment, the nozzle (200) is designed such that aqueous suspension (210) is allowed to swirl around the main flow axis of the at least one nozzle by creating, rotating and accelerating a flow of the aqueous suspension, where all the fibers are well aligned with the said flow by rotating around the main flow axis.

In another embodiment, the nozzle (200) is such that aqueous suspension (210) is allowed to swirl around the main flow axis of the at least one nozzle by creating a swirling flow through a plurality of grooved flow channels.

In various embodiments, the aqueous suspension (210) is allowed to swirl around the main flow axis of the at least one nozzle (200) by creating a swirling flow through a plurality of bend flow channels. The bend flow channels may comprise ninety degree bend flow channels.

In another embodiment, the annular flow of the metal alginate hydrogel is adapted to combine a plurality of fibrous yarns through a plurality of annular flow channels. The pluralities of fibrous yarns are combined by using a plurality of small nozzles directed radially inside the annular flow of the metal alginate hydrogel.

The plurality of annular flow channels, as referenced above, include an innermost annular flow channel, an outermost annular flow channel, and an annular flow channel sandwiched between the innermost annular flow channel and the outermost annular flow channel.

In various embodiments, the innermost annular flow channel is adapted to accommodate the fiber suspension and the rheology modifier. The outermost annular flow channel is adapted to accommodate the metal alginate hydrogel. The sandwiched annular flow channel is adapted to accommodate the yarn property improving additives.

Accordingly, the final yarn product thus produced by the above method possesses improved yarn strength as well as improved yarn diameter. The swirling of the aqueous suspension around the main flow axis of the nozzle and treating the suspension with metal alginate hydrogel as well as yarn property improving additives through the plurality of annular flow channels produces a fibrous yarn having improved strength and diameter.

Figure 3:
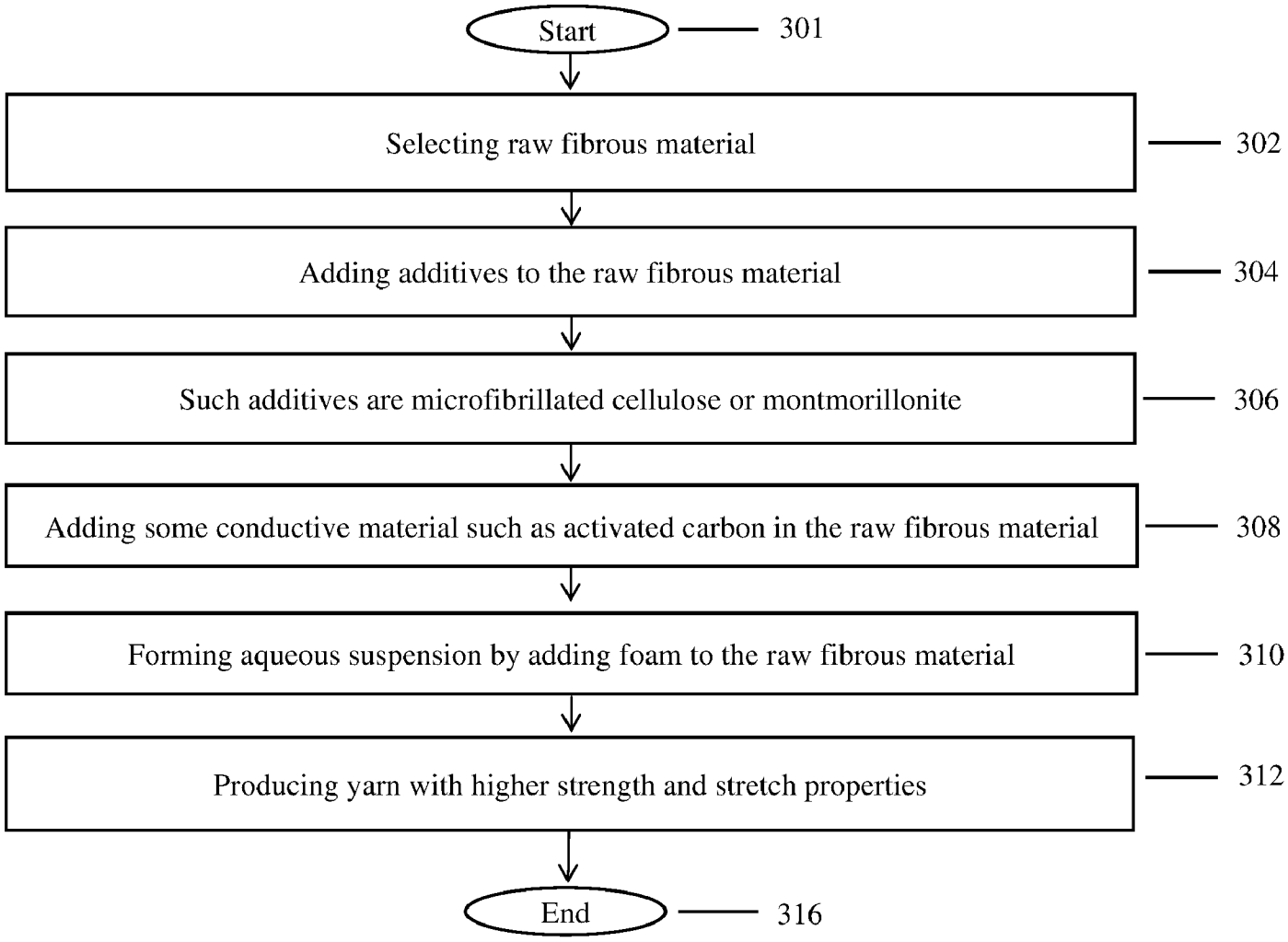
FIG. 3 illustrates a flow diagram for the method of selecting various raw materials, according to various embodiments of the present invention.
Figure 4:
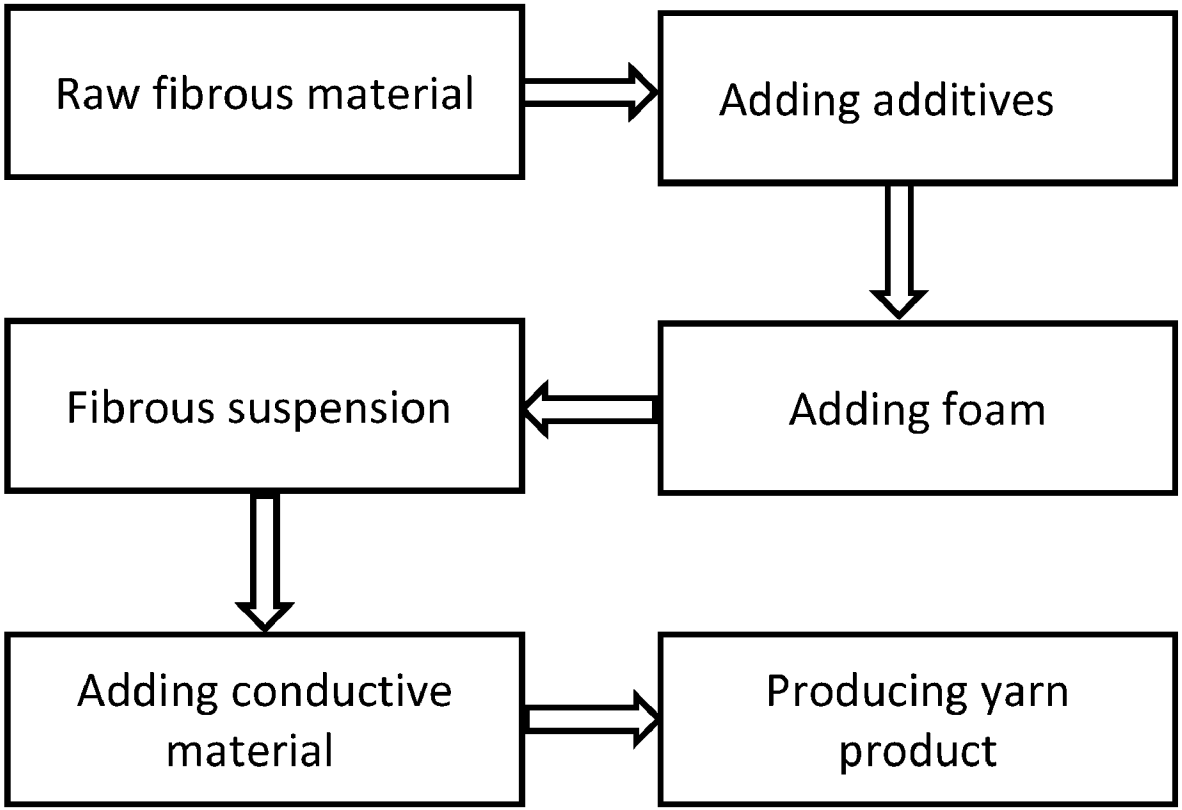
FIG. 4 illustrates a block diagram of the system for producing a fibrous yarn from various raw materials, according to various embodiments of the present invention.

FIG. 3 provides a flow diagram for the method for selecting raw materials. Further, FIG. 4 provides a block diagram for the method for selecting raw materials.

Firstly, raw fibrous material is selected from natural fibers or synthetic fibers as per step 302. Then additives such as microfibrillated cellulose or clay (e.g. bentonite, montmorillonite) are added to the raw fibrous material as per step 304 and 306. Further, some conductive material such as activated carbon is added in the raw fibrous material as per step 308. Further, an aqueous suspension is prepared by adding foam to such raw fibrous material as per step 310. Finally the yarn with the higher strength and stretch properties is produced as per step 312.

The natural fibers as provided herein are selected from the plant based raw material source which may be a virgin source or recycled source or any combination thereof. It may be wood or non-wood material. The wood may be softwood tree such as spruce, pine, fir, larch, douglas-fir or hemlock, or hardwood tree such as birch, aspen, poplar, alder, eucalyptus or acacia, or a mixture of softwoods and hardwoods. The non-wood material may be plant, such as straw, leaves, bark, seeds, hulls, flowers, vegetables or fruits from corn, cotton, wheat, oat, rye, barley, rice, flax, hemp, manilla hemp, sisal hemp, jute, ramie, kenaf, bagasse, bamboo, reed or peat.

Suitably virgin fibers originating from pine may also be used. Said fibers typically may have average length weighed fiber length from 2 to 3 millimeters. Also combinations of longer fibers with shorter ones may be used, for example fibers from pine with fibers from eucalyptus.

The aqueous suspension as provided herein may optionally comprise virgin or recycled fibers originating from synthetic materials, such as glass fibers, polymeric fibers, metal fibers, or from natural materials, such as wool fibers, or silk fibers.

The aqueous suspension as provided herein may comprise from 0.1 to 10 percent (%) weight/weight (w/w), preferably from 0.2 to 5% w/w of fibers originating from any plant based raw material source.

Preferably, in embodiments of the present invention the aqueous suspension may be in the form of foam. In that case the suspension includes at least one surfactant selected from anionic surfactants and non-ionic surfactants and any combinations thereof, typically in an amount of from 0.001 to 1% w/w.

The aqueous suspension may include at least one rheology modifier that forms a gel by crosslinking the aqueous suspension, The rheology modifier may be selected from alginic acid, alginates such as sodium alginate, pectin, carrageenan, and nanofibrillar cellulose (NFC), or a combination of rheology modifiers.

Preferably, the rheology modifier may be an additive added to improve the properties of the final yarn product. Such additives are selected from the group of components including montmorillonite, polyester, nylon, metals, ions, any electrically conductive material and/or activated carbon.

Said rheology modifier may be used in an amount from 0.1 to 20 weight %. Concentration of the rheology modifier, such as alginate is preferably 0.5-20% w/w.

The aqueous suspension as provided herein may also include at least one dispersion agent that is typically anionic long chained polymer or NFC, or a combination of dispersion agents. Examples of suitable dispersion agents are carboxymethyl cellulose (CMC), starch (anionic or neutral) and anionic polyacrylamides (APAM), having high molecular weight. Dispersion agent modifies the suspension rheology to make the suspension shear thinning. Preferably at high shear rates (500 1/s) shear viscosity is less than 10% of zero shear viscosity of the suspension.

Said dispersion agent may be used in an amount from 0.1 to 20 weight %.

The aqueous suspension as provided herein may be obtained using any suitable mixing method known in the art.

Moist yarn having metal alginate hydrogel coating as obtained from the nozzle (at step 312) initially contains water typically from 30 to 99.5% w/w. In the dewatering step the yarn may be dried to desired water content. Accordingly, the fibrous yarn in the form of gel exiting from the nozzle is subjected to the dewatering and twisting process.

In addition and with reference to the aforementioned, embodiments of the invention comprise the aqueous suspension having fibers and at least one rheology modifier is allowed to swirl around the main flow axis of the nozzle. Such swirling of the aqueous suspension around the main flow axis of the nozzle is completed by feeding the aqueous suspension asymmetrically from the side of the nozzle. Further, yarn property improving additives is also added to the aqueous suspension. Furthermore, a metal alginate hydrogel is merged with the flow of the aqueous suspension at the exit of the nozzle. Moreover, the aqueous suspension at the exit of the nozzle is pulled and twisted and then subjected to pressing and dewatering process.

Figure 5:
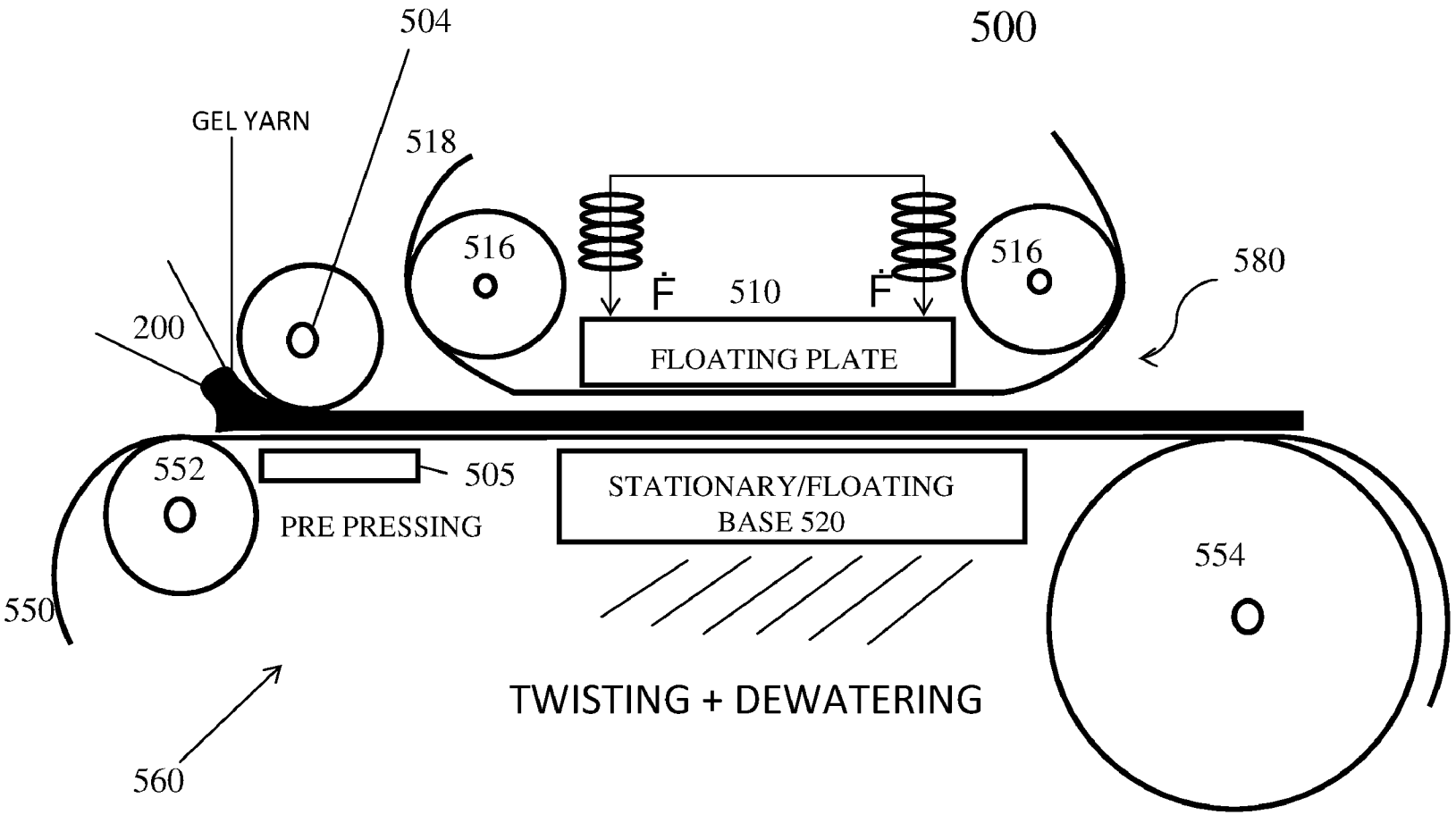
FIG. 5 illustrates a block diagram related to the system of the entire yarn producing machine, according to various embodiments of the present invention.
Figure 6:
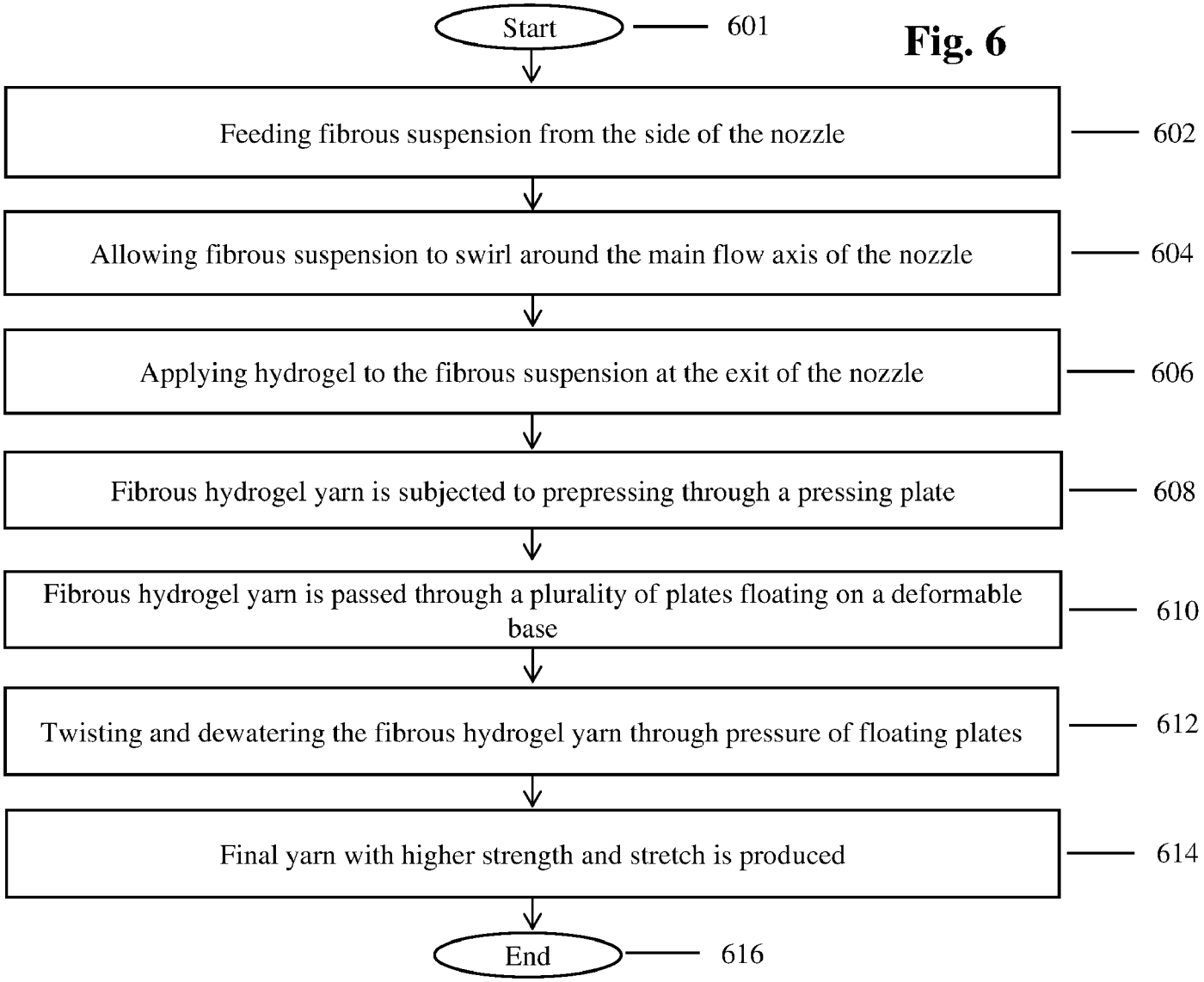
FIG. 6 illustrates a flow diagram related to the method of the entire yarn producing machine, according to various embodiments of the present invention.

The dewatering and twisting of the yarn is facilitated using dewatering apparatus (580) as shown in FIGS. 5-6, which is now explained.

The fibrous gel yarn at the exit of the nozzle, such as nozzle (200), is dropped on a conveyer system (560) having a conveyer belt (550) [also referred as wire (550) or base wire (550)] operating on rollers (552) and (554). Due to the movement of the conveyer system (560), the fibrous gel yarn is pulled in the dewatering apparatus (580).

Thereafter, the pulled fibrous gel yarn is subjected to pre-pressing through a pressing plate, such as pressing plate (505) and roller (504) assembled for that purpose, at step 608. Thereafter, at step 610, the fibrous gel yarn is passed through a plurality of plates, such as plates (510), in FIG. 5. The floating plates (510) are floating on a deformable base (520). In one embodiment, the floating plates (510) are floating over a stationary base (520).

The floating plates (510) and the deformable/stationary base (520) are supported by a conveyer system having plurality of rollers (516) running a conveyer belt (518) [also referred as wire (518) or upper wire (518)]. This system allows pulling and twisting of the fibrous yarn in the dewatering apparatus (580).

The plurality of floating plates (510) applies suitable pressure as required for the dewatering of the fibrous gel yarn, at step 610. Further, the plurality of floating plates (510) is adapted to twist and dewater the fibrous gel yarn for dewatering at step 612. Moreover, the floating plates (510) are adapted to maintain the uniform round shape of the yarn during the dewatering phase and give a good tensile strength to the final yarn product at step 614.

FIGS. 5 and 6 provide block diagram and flow chart respectively for the system of the entire yarn producing apparatus (500) as proposed by the present invention. The system includes an aqueous suspension having fibers and at least one rheology modifier, fed in the nozzle (200). The system further includes the dewatering apparatus (580). The nozzle (200) is adapted to arrange a swirling flow of the aqueous suspension. The system further includes a pressing mechanism having the conveyer system (560) with rollers (552), (554) and belt, which pulls the fibrous gel in the dewatering apparatus (580).

The dewatering apparatus (580) includes pre-pressing roller (504) and plate (505) which pre-presses the yarn to dehydrate it, and floating plates (510) supported on stationary/floating base (520), which twists the yarn.

FIG. 6 specifically illustrates a flow diagram explaining operation of yarn producing apparatus. The aqueous suspension having fibers and foam along with yarn property improving additives are fed from the nozzle (200). In one embodiment, they may be fed from the side of the nozzle, such as nozzle (200), at step 602. The nozzle (200) is adapted to swirl the flow of the aqueous suspension along the main flow axis of the nozzle, at step 604. Then at the exit of the nozzle, the aqueous suspension pulled and twisted and merged with the annular flow of a metal alginate hydrogel, at step 606.

Then fibrous gel yarn at the exit of the nozzle is subjected to the dewatering process as explained hereinabove.

It should be noted that any features, steps, phases or parts of embodiments as hereinabove disclosed can be freely permuted and combined with each other in a combination of two or more embodiments in accordance with the invention.

The invention provides several advantages. The manufacturing method is very simple and effective, and the equipment needed is simple and relatively cheap. The yarn is produced directly from the fiber suspension and it is not necessary to manufacture first paper strips.

The rheology of the fiber suspension may be adjusted using rheology modifiers to the viscosity and thixotropy range where the fiber suspension can be pumped through the nozzle without clogging it, but simultaneously to provide a moist yarn typically in gel form, which has sufficient strength to maintain its form during the drying step. Thus the rheology modifier gives shear thinning nature and strength to the yarn; in the case alginate is used a dispersion agent is typically also needed and the treatment of the moist yarn with a salt solution to provide sufficient strength. The selection of the inner diameter of the outlet of the nozzle to smaller than or equal to the maximum length weighed fiber length of the fibers achieves the fibers to orientate in the direction of the yarn, which provides the final product flexibility and strength.

The water released after drying may be recovered by condensing and recycled in the method, for example by using a closed system, and thus practically no wastewater is formed. Also the amount of water needed in the process is very limited, particularly in the embodiment where the fiber suspension is provided in the form of foam.

The product is completely biodegradable when the starting materials used are natural materials.

The need of cotton may be reduced with the method and products of the present invention, where the fibers originate at least partly from more ecological plant material, such as wood and recycled paper.

Particularly, long fiber pulp, suitably manufactured from Nordic pine, may be used in the method to provide a yarn having the thickness of less than 0.1 mm and very good strength properties.

While the invention has been described with respect to specific examples presented in the figures, including presently preferred modes of carrying out the invention, those skilled in the art will appreciate that there are numerous variations and permutations of the above described embodiments that fall within the spirit and scope of the invention. It should be understood that the invention is not limited in its application to the details of construction and arrangements of the components set forth herein. Variations and modifications of the foregoing are within the scope of the present invention.

Accordingly, many variations of these embodiments are envisaged within the scope of the present invention.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to explain the principles of the present invention and its practical application, and to thereby enable others skilled in the art to utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present invention.

The invention claimed is:

1. A method for manufacturing plant based fibrous yarn, said method comprising:

a) providing an aqueous suspension comprising fibers originating from at least one plant based raw material source and at least one rheology modifier, b) feeding the aqueous suspension asymmetrically from a side of at least one nozzle such that the suspension swirls around a main flow axis of the nozzle and directing said suspension through the at least one nozzle for forming at least one yarn, c) merging a metal alginate hydrogel with the flow of the aqueous suspension at the exit of the at least one nozzle to form a hydrogel coating onto surface of the at least one yarn as the yarn exits the at least one nozzle, and d) subjecting the at least one yarn to dewatering.

2. The method as claimed in claim 1, further comprising a step of providing an additive into the aqueous suspension for altering the properties of said at least one yarn.

3. The method as claimed in claim 2, wherein said additive is any one of the following: clay, polyester, nylon, metals, ions, any electrically conductive material and/or activated carbon.

4. The method as claimed in claim 1, comprising initiating formation of said hydrogel at an exit of the nozzle in free jet region, wherein the aqueous suspension is merged with an annular flow of a solution containing metal ions.

5. The method as claimed in claim 1, comprising replacing water in said aqueous suspension with foam.

* * * * *